United States Patent [19]

Graney

[11] 4,116,251

[45] Sep. 26, 1978

[54] LOG SPLITTER WITH GEAR RACK DRIVE

[76] Inventor: Francis X. Graney, 50 Vale St., Tewksbury, Mass. 01876

[21] Appl. No.: 818,125

[22] Filed: Jul. 22, 1977

[51] Int. Cl.[2] ..... B27L 7/00

[52] U.S. Cl. ..... 144/193 R; 74/30; 144/3K; 254/97

[58] Field of Search ..... 144/193 R, 3 K; 74/30, 74/31, 89.15; 254/96, 97

[56] References Cited

U.S. PATENT DOCUMENTS

| | | | |
|---|---|---|---|
| 1,457,966 | 6/1923 | Eastman | 144/193 R |
| 2,468,147 | 4/1949 | Vonada | 74/31 K |
| 3,730,008 | 5/1973 | Sheesley | 74/89.15 |

*Primary Examiner*—Frank T. Yost
*Assistant Examiner*—W. D. Bray
*Attorney, Agent, or Firm*—Pearson & Pearson

[57] ABSTRACT

A log splitter of the horizontal track, upstanding blade, reciprocating carriage type is driven by mechanical rather than hydraulic mechanism to reduce cost and weight and breakage. Instead of crank arms, a gear rack and spur gear system is provided, there being a large drive gear meshed with the spur gear, and a small diameter, light weight flywheel on the motor drive shaft, the mechanical advantage being sixteen to one or more. A safety overload kick-off is incorporated into the control mechanism for automatic actuation when a log presents unusual resistance to splitting.

8 Claims, 4 Drawing Figures

LOG SPLITTER WITH GEAR RACK DRIVE

BACKGROUND OF THE INVENTION

There have been many different structures proposed for splitting logs, some horizontal, some vertical, some driven by hydraulic mechanism and some driven by mechanical mechanism. Usually the mechanical mechanism has involved a fixed abutment and a pusher blade movable along a horizontal track, or beam by means of crank arms or pitman, to push the movable blade through the fixed log for splitting.

Exemplary of such devices are U.S. Pat. No. Re. 13221 to Power of Mar. 21, 1911, U.S. Pat. No. 1,231,525 to Hauberg of June 26, 1917, U.S. Pat. No. 1,666,795 to Schmidt of Aug. 17, 1928, and U.S. Pat. No. 2,446,585 to Hanners of Aug. 10, 1948.

Log splitting mechanisms using a horizontal track, or beam, a fixed blade at one end of the beam and a log pushing carriage movable toward the blade by hydraulic mechanism are taught in U.S. Pat. No. 3,280,864 to Spanenberg of Oct. 25, 1966, U.S. Pat. No. 3,760,854 to Worthington of Sept. 25, 1973 and many other patents.

While all of the log splitting devices of these, and other patents, probably perform their function adequately, the types which have reached the present day market appear to be relatively costly, slow moving and subject to breakage under continual use.

SUMMARY OF THIS INVENTION

In this invention a log splitter is disclosed which can be easily moved about horizontally on a set of trailer wheels and which requires few machined parts but rather requires only relatively low cost, rugged, long lasting parts. The splitter comprises an elongated track, in the form of a horizontal I beam, a blade removably affixed in upstanding position at one end of the track a log pushing carriage slideable on, and retained on the track and gear rack and spur gear, motor driven mechanism for advancing the carriage toward the blade.

A large diameter, heavy fly wheel may be used in permanent installations but preferably mechanical advantage is obtained by a large low cost gear driving the spur gear shaft and a small diameter gear meshed with the teeth of the large gear and fast on the motor drive shaft together with a small, fly wheel of lesser weight.

Control is obtained by rotating the spur gear continuously and unidirectionally while normally poising the gear rack out of mesh with the spur gear by a coil spring. Pressure on one end of a pivoted hand lever moves the rack into mesh with the gear to advance the pusher carriage to split the log.

The elongated gear rack provides considerably longer push on the carriage than can be obtained by crank arms of reasonable length and overload kick-off mechanism is incorporated into the control by way of a cam, cam follower spring and roll.

DESCRIPTION OF A PREFERRED EMBODIMENT

Figure 1:
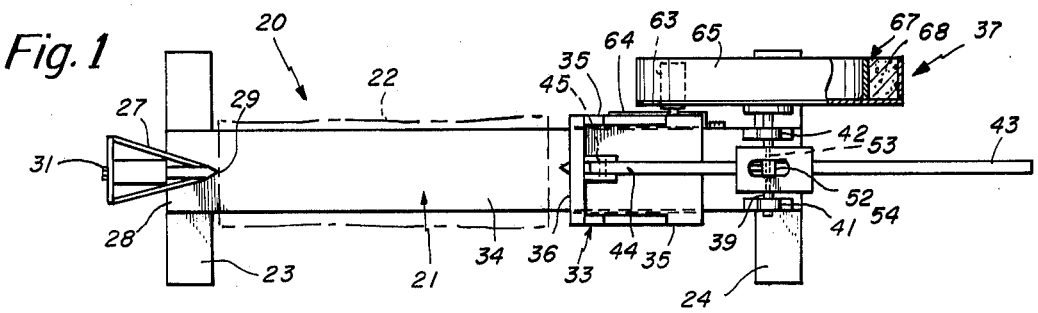
FIG. 1 is a top plan view.

The log splitter 20 of the invention includes the horizontal, log-supporting track 21, which is preferably a steel I beam, and which constitutes the support for a log 22, to be split by the device. The track 21 is supported on the bases 23 by posts 24 and 25 but can be mounted on trailer wheels, if desired, in a manner well known in the art.

A splitter blade 27 is fixed in upstanding position, at one end 28 of the track, the blade having a sharp cutting edge 29, and being easily removable and replaceable when worn by bolts 31. Shear pins 32 are also provided to yield under extreme resistance to advance of the log by the carriage.

The log pusher carriage 33 is slidably mounted on the upper rail 34 of steel, I-beam, track 21 with flanges 35 for retainment and an upstanding pusher plate 36 for engaging the adjacent end of a log 22.

Power means 37 is provided for driving the carriage 33 to push a log 22 to be split by the sharp edge 29 of the blade 27 and to travel the carriage far enough to clear the split portions of the log in a direction end-wise of the rail for a substantial distance.

Power means 37 includes at least one spur gear 38 fast on a shaft 39 supported in a pair of spaced bearing blocks 41 and 42 on the upper rail 34 of track 21. Means 37 also includes an elongated gear rack 43 having one end 44 pivoted at 45 to the carriage 33 and having teeth 46 along the underface 47 normally poised proximate, but out of mesh with, the teeth 48 of the spur gear by the coil spring 49.

Control mechanism 51 is provided to selectively engage and disengage the gear rack teeth 48 with the spur gear teeth 46, and includes a lever 52 pivoted at 53 to a bracket 54 affixed at the other end of track 21. The lever 52 includes a handle 55 above the pivot 53 and the other end 56 of the lever, when pivoted downwardly, contacts the upper face 57 of the gear rack to push it downward into mesh. A stop 58 is preferably provided for the lower end 56 of the lever 52.

Upon engagement of the gear rack teeth with the unidirectionally rotating teeth of the spur gear, the gear rack is advanced over a long path of travel to split the log and discharge the pieces endwise for a considerable distance. The lever 52 tilts by the weight of the handle 55 to lift the gear rack teeth out of mesh with the spur gear teeth, while a retraction spring 59 returns the gear rack and carriage ready for the next forward stroke.

Figure 2:
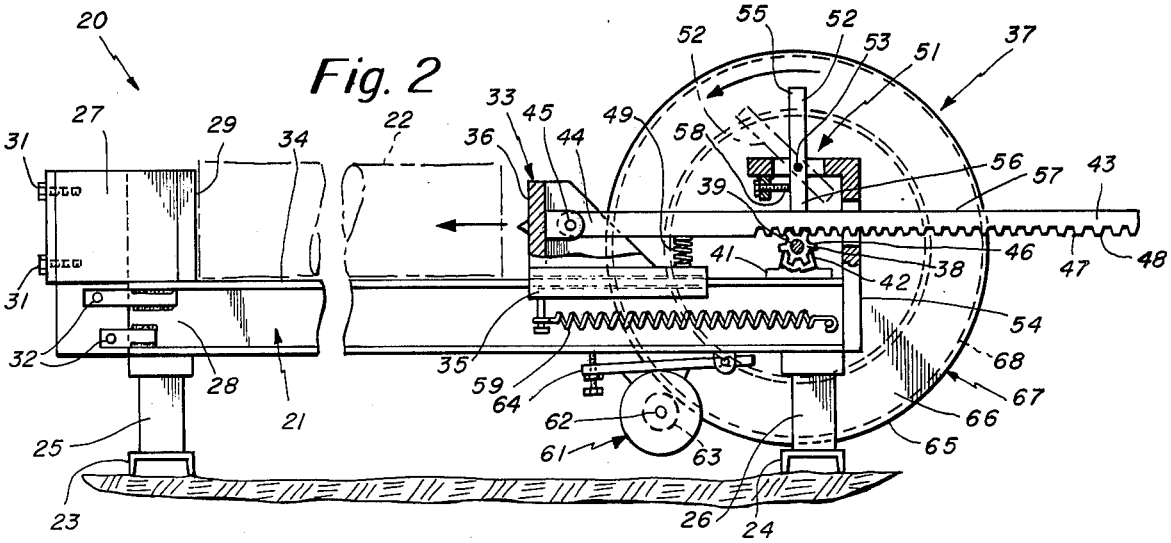
FIG. 2 is a side elevational view.
Figure 3:
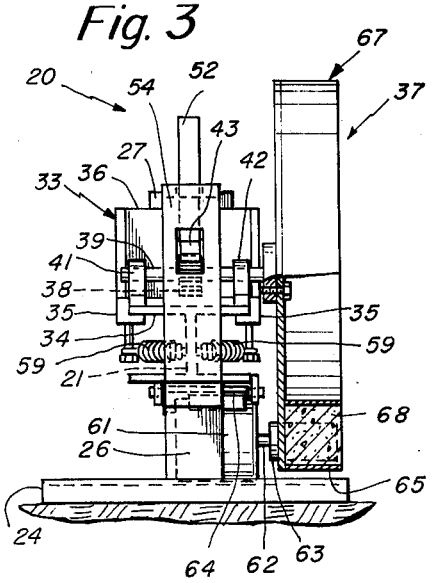
FIG. 3 is an end elevational view of one embodiment of the invention.

In the embodiment of FIGS. 1–3 the drive motor 61, which may be electric, or gasoline, has a drive shaft 62 with a small diameter, rubber faced roller 63 thereon, the motor being mounted on a pivoted, threadedly adjustable mounting plate 64 under track 21. The roller 63 frictionally engages the periphery 65 of the hollow, tubular rim 66 of a large diameter unusually heavy fly wheel 67 fast on spur gear shaft 39, and filled with cement or other heavy hardened material 68.

Figure 4:
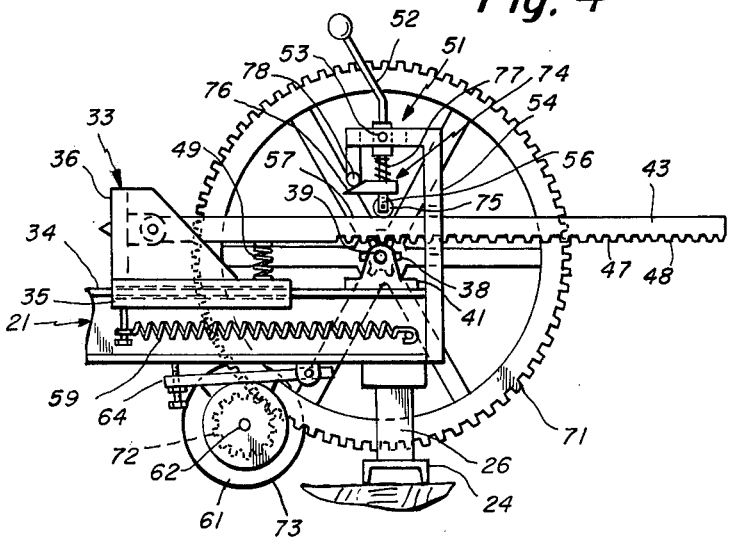
FIG. 4 is a fragmentary view, similar to FIG. 2, but showing the preferred embodiment of the invention with large gear, small fly wheel and an overload kick-off device.

In the preferred embodiment of FIG. 4, all of the parts of the log splitter 20 remain the same as in the embodiment of FIGS. 1–3 except that the unusually heavy fly wheel 67 has been eliminated in favor of a large diameter, but much lighter, drive gear 71, which is driven by the small drive gear 72 fast on motor shaft 62, there being a small diameter fly wheel 73, of light weight, also fast on the motor drive shaft 62. The drive gear 71 is fast on the spur gear shaft 39 to produce a mechanical advantage of at least sixteen to one.

Safety overload, kick-off means 74 is also included in the preferred embodiment of FIG. 4, consisting of a roller 75 rotatably mounted at the lower end 56 of the pivoted lever 52 of the control mechanism 51 and in rollable contact with the upper face 57 of gear rack 43. A cam follower 76 and the roller 75 are spring based downwardly by coil spring 77 and yieldable upwardly under predetermined pressure from gear rack 42, due to resistance to splitting of the log, to cause the cam 78 to kickoff, or pivot, the lever 52 in the direction of the arrow to disengage the gear rack teeth 48 from the spur gear teeth 46.

I claim:

1. A log splitter of the type having a horizontal, log-supporting, track, a splitter blade upstanding at one end of said track, a log-pusher carriage mounted to reciprocate along said track and power means for driving said carriage to push a log against said blade to split the same, characterized by:

said power means comprising:

a spur gear rotatably mounted at the other end of said track;

an elongated gear rack having a forward end pivotally connected to said carriage and having teeth adapted to engage the teeth of said spur gear but normally poised at a spaced distance therefrom;

control mechanism for selectively engaging and disengaging said teeth;

a drive motor, with a drive shaft unidirectionally rotating said spur gear to advance said gear rack and carriage, with a log supported on said track, into splitting engagement with said blade;

and retraction means for retracting said carriage when said teeth are disengaged.

2. A log splitter as specified in claim 1 wherein:

said control mechanism comprises a spring biased to urge said rack away from said spur gear and;

a hand lever, pivoted proximate said other end of said track, and having one end in slidable contact with said gear rack;

pivoting the other end of said lever causing enmeshment of the teeth of said rack with the teeth of said spur gear.

3. A log splitter as specified in claim 1 wherein:

said power drive means includes a fly wheel rotatably mounted on said track and operably connected to said spur gear, said fly wheel being rotated by said drive motor to rotate said spur gear.

4. A log splitter as specified in claim 3 wherein:

said fly wheel is of large diameter with a hollow tubular rim, said rim being filled with hardened, heavy filler.

5. A log splitter as specified in claim 1 wherein:

said power drive means includes a large diameter gear operably connected to said spur gear for rotating the same;

said drive shaft having a small diameter gear thereon, meshed with said large diameter gear for rotating the same;

and a small diameter fly wheel fast on the drive shaft of said motor.

6. A log splitter as specified in claim 1 wherein:

said control means includes safety overload kick-off means for disengaging said gear rack from said spur gear when said carriage encounters predetermined resistance to advance of a log against said splitter blade.

7. A log splitter as specified in claim 6 wherein:

said safety overload and kick-off means comprises a roller on said one end of said hand lever in rolling contact with said gear rack;

spring means yieldably urging said roller toward said rack;

and cam and cam follower means associated with said one one end of said lever for kicking said one end of said lever in the pivot direction of disengagement of said rack and spur gear under predetermined resistance to splitting of said log.

8. A log splitter comprising a horizontal track;

a log pusher carriage slidably mounted on said track;

an upstanding, log splitting blade fixed at one end of said track in the horizontal path of said carriage;

a spur gear rotatably mounted intermediate of said beam;

a gear rack having one end pivoted to said carriage and having teeth spaced along its underside adapted to engage the teeth of said spur gear, but normally poised out of mesh therewith by a spring;

control mechanism for selectively meshing said teeth to drive said carriage toward said blade to split a log;

and a drive motor unidirectionally rotating said spur gear to advance said rack and carriage.

* * * * *